United States Patent [19]

Baroody

[11] 4,126,245

[45] Nov. 21, 1978

[54] PULL TAB TOPS FOR SEALED CONTAINERS

[76] Inventor: John J. Baroody, 58 Oak St., Geneva, N.Y. 14456

[21] Appl. No.: 838,992

[22] Filed: Oct. 3, 1977

[51] Int. Cl.[2] ..... B65D 41/32

[52] U.S. Cl. ..... 220/279; 220/359; 215/257

[58] Field of Search ..... 215/257; 220/279, 270, 220/359; 229/7 R

[56] References Cited

U.S. PATENT DOCUMENTS 2,925,188 2/1960 Grumbles ..... 215/257

*Primary Examiner*—George T. Hall

*Attorney, Agent, or Firm*—Howard I. Podell

[57] ABSTRACT

A seal for the closure of packages includes a tear string or tab dimensioned or located and secured thereon so as to selectively open desired sections of the seal.

4 Claims, 7 Drawing Figures

PULL TAB TOPS FOR SEALED CONTAINERS

FIELD OF THE INVENTION

This invention relates to packaging units comprising a container having a lid which covers the opening and seals the same and is primarily concerned with a tab arrangement coacting with the lid to open desired sections thereof.

STATEMENT OF PRIOR ART

The prior art to which the invention relates is familiar, for example, with U.S. Pat. Nos.: 2,239,691; 3,604,615; 3,799,389; and 2,350,870. However, the devices suggested in the above-mentioned patents differ radically in concept, design and/or operation from the present invention.

The principal object of this invention is to provide a device or article of this character which combines simplicity, strength and durability in a high degree, together with inexpensiveness of construction.

Other objects of this invention will in part be obvious and in part hereinafter pointed out.

The invention accordingly consists in the features of construction, combinations of elements, and arrangement of parts which will be exemplified in the construction hereinafter described, and of which the scope of application will be indicated in the following claims.

BRIEF DESCRIPTION OF THE DRAWINGS

In the accompanying drawing, in which is shown one of the various possible illustrative embodiments of this invention, wherein like reference character identify the same or like parts.

DESCRIPTION OF THE PREFERRED EMBODIMENT

Figure 1:
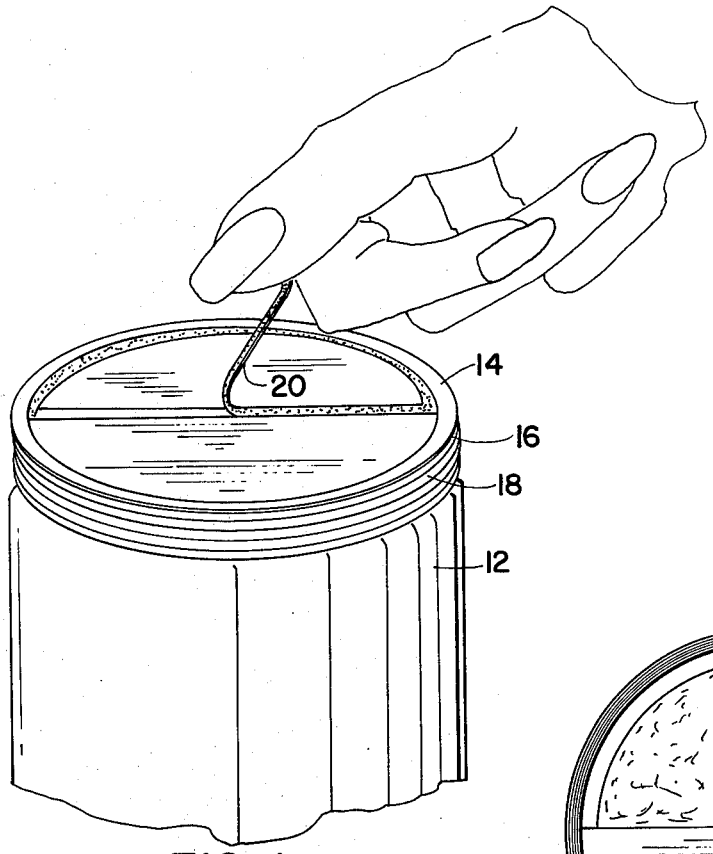
FIG. 1 is a perspective view of the invention.

With reference to the drawing, there is shown and illustrated a SEAL AND TAB ASSEMBLY constructed in accordance with the principles of the invention and designated generally by reference character 10.

The drawing in FIG. 1 shows a cylindrical container 12 which can be an instant coffee jar, or an instant non-dairy cream or a container for cosmetic or pharmaceutical products. More generally the container is any receptacle to which a wax paper or foil lid 14 is sealed by its gummed underside 16 to opening 18 of the container.

Secured by glueing or heat sealing to lid 14 is a tab or tear string 20. This member, as required, can be of plastic, light gauge copper or steel wire; nylon, silk or a thin metal ribbon or foil.

In FIGS. 2–7, the side of the lid shown is that which is sealed to the rim of the opening of the container so that pulling the tab 20 by its overlapping end 21 up and across the lid, the lid will be opened according to the way the tab is disposed relative thereto.

Figure 2:
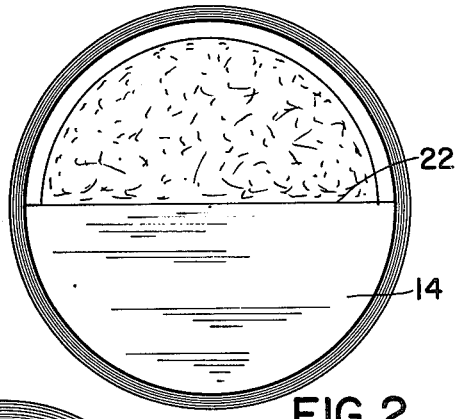
FIGS. 2 through 7 are bottom plan views of modifications of the invention.

In FIG. 1 the tab is arranged hemispherically so as to open one half of the lid as shown in FIG. 2. This opening is large enough to permit insertion of a tablespoon or teaspoon. The straight edge 22 of the remaining part of the lid can be used to level off the spoon.

Figure 3:
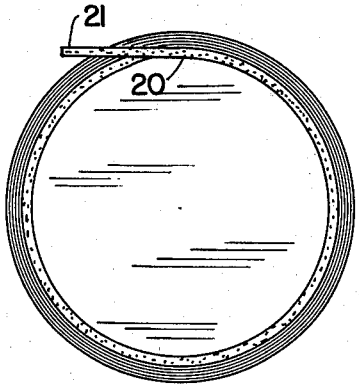

FIG. 3 is a modification wherein the tab is arranged to remove all of the top at the gum seal.

Figure 4:
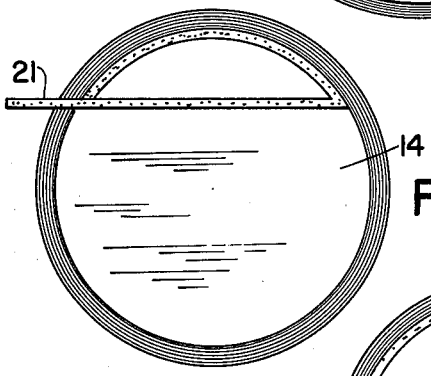

FIG. 4 shows the arrangement of the tab which will open one quarter of the lid.

Figure 5:
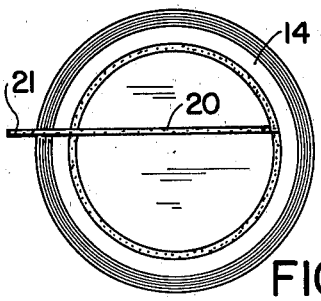

FIG. 5 shows the arrangement which removes all of the lid at the gum seal or where the tab may be stopped at the starting point leaving half the lid intact. The tab is placed 3/16 inch inside the lid.

Figure 6:
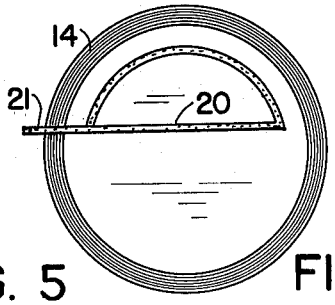

FIG. 6 is similar to FIG. 4 except that the tab is positioned 3/16 inch inside the lid.

Figure 7:
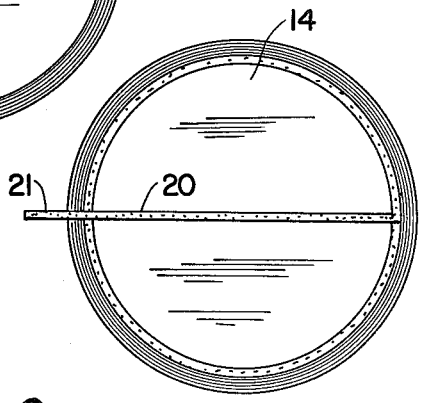

FIG. 7 shows an arrangement of the tab for removing the whole or half the lid with the tab shaped to first tear out a half of the lid, when pulled, with further pulling acting to remove the entire lid.

The operation and use of the invention hereinabove described will be evident to those skilled in the art to which it relates from a consideration of the foregoing.

It will thus be seen that there is provided a device in which the several objects of this invention are achieved, and which is well adapted to meet the conditions of practical use.

As various possible embodiments might be made of the above invention, and as various changes might be made in the embodiment above set forth, it is to be understood that all matter herein set forth or shown in the accompanying drawing is to be interpreted as illustrative and not in a limiting sense.

Having thus described my invention I claim as new and desire to secure by Letters Patent:

1. In combination with a container having a circular opening bounded by a circular rim and closed by a tearable circular lid sealed to said rim at the outer periphery thereof by gum or adhesive;

a tear tab or string secured to the bottom of said lid intermediate said lid and said rim and having a free end first section protuding from beyond said lid; said tab being arranged on said lid so as to provide tearing of preselected portions when a pulling force is applied to said free end in a direction away from said container and substantially perpendicular to said rim, with said tear tab substantially bounding the said preselected portion of the lid that is to be torn from the container, in which a second section of said tab is arranged between said lid and said rim, along the circular path of the rim.

2. The combination as recited in claim 1 in which the said second section of said tab extends substantially all about the circular rim of the container, and is joined at one end to the said first section.

3. The combination as recited in claim 1 in which the said second section of said tab extends for a portion about the circular rim of the container to join a third section of the said tab that extends substantially along a straight line as a chord of the arc of the second section of said tab, with an end of the said third section joined to said first section.

4. The combination as recited in claim 1 in which the said second section of said tab extends substantially all about the circular rim of the container and is joined at one end to a third section of the container that extends as a straight line across the lid to join the said first section.

* * * * *